United States Patent [19]

Crofoot

[11] 4,026,082

[45] May 31, 1977

[54] VENT FRAMES

[76] Inventor: Percy Crofoot, P.O. Box 130, Silver Lake, Oreg. 97638

[22] Filed: Feb. 24, 1975

[21] Appl. No.: 552,438

[52] U.S. Cl. ..... 52/302; 52/656; 98/37; 160/104

[51] Int. Cl.[2] ..... E04B 1/70

[58] Field of Search .... 52/656, 660, 676, 302–305; 160/380, 104; 98/885, 37

[56] References Cited

UNITED STATES PATENTS

| | | | |
|---|---|---|---|
| 1,480,298 | 1/1924 | Pearson | 160/380 X |
| 2,891,615 | 6/1959 | Farrell | 98/37 X |
| 3,220,079 | 11/1965 | Aggson | 52/302 |
| 3,757,664 | 9/1973 | Jalbert | 98/37 |

FOREIGN PATENTS OR APPLICATIONS

| | | | |
|---|---|---|---|
| 1,177,505 | 1/1970 | United Kingdom | 98/37 |

*Primary Examiner*—J. Karl Bell
*Attorney, Agent, or Firm*—Robert W. Beach

[57] ABSTRACT

A flared peripheral wall has an inner end internal flange forming the margin of a vent opening and an outer end external flange. Ribs projecting outward from the peripheral wall can be embedded in concrete to prevent displacement of the wall. Screen cloth covering the vent aperture is secured to the inner end internal flange. The vent aperture is closable by a sheet cover having resilient retaining flanges or by a plug of foam plastic.

8 Claims, 10 Drawing Figures

Fig. 5
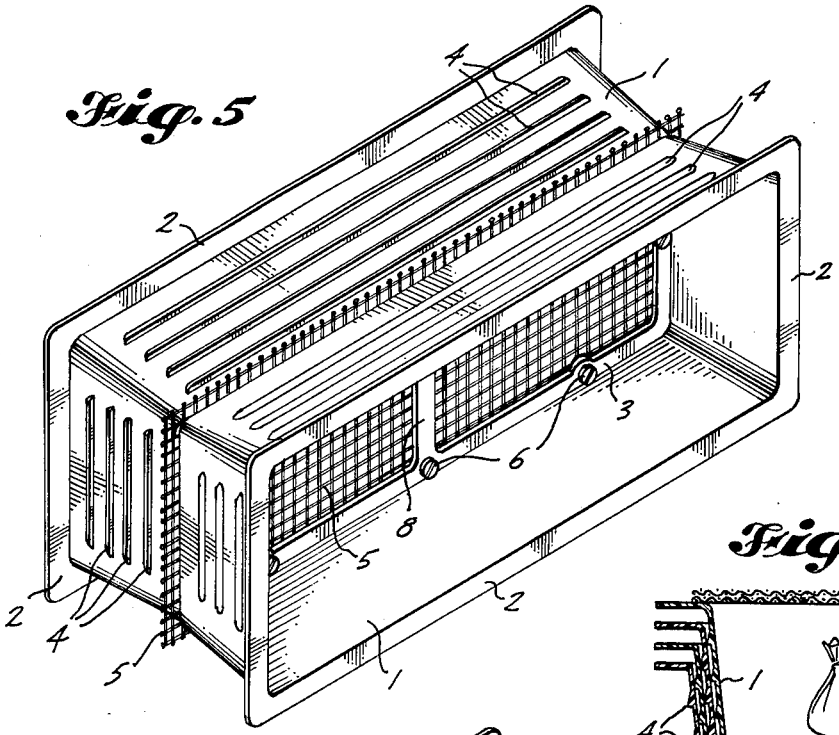
Fig. 7
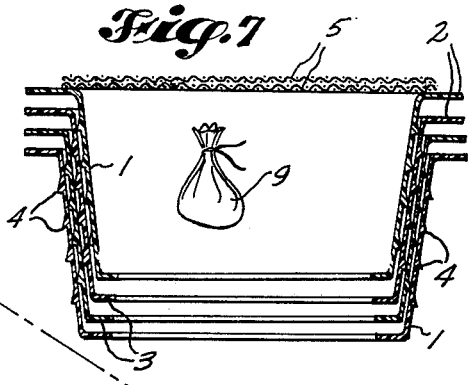
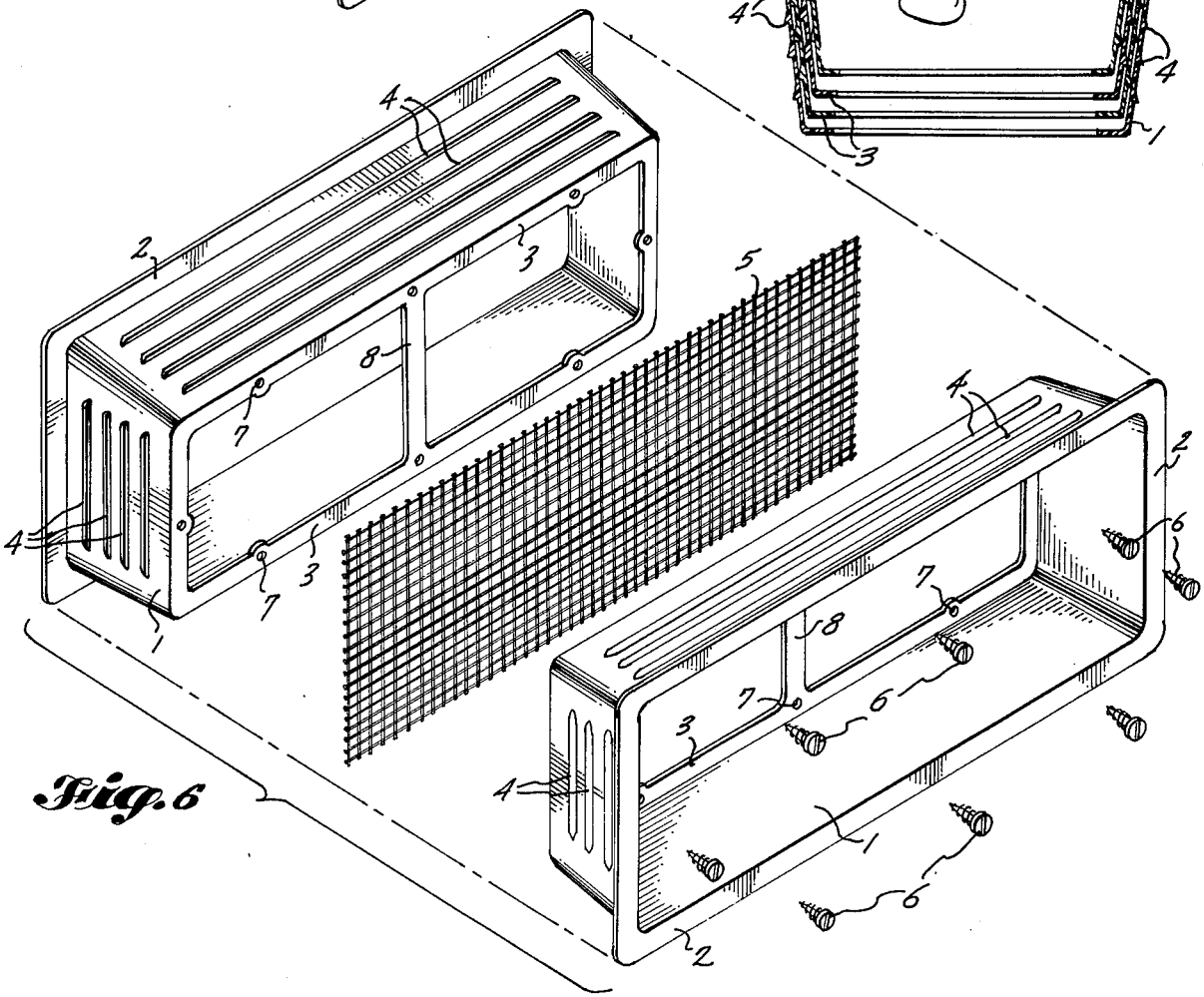
Fig. 6

VENT FRAMES

BACKGROUND OF THE INVENTION

1. Field of the Invention

This invention relates to frames for vents in building walls.

2. Prior Art

Customarily vents in concrete walls have been framed in connection with the concrete wall forms so that, when the concrete has been poured and the formwork removed, the vent aperture remains in the concrete. Sometimes cloth screen has been included in the formwork, so that the margin of the screen will be embedded in concrete to hold it in position covering the vent. In other instances screen cloth has been secured over one of the aperture sides after the formwork has been removed.

In wood walls vent apertures have simply been cut or formed in the walls and then covered with screen cloth.

SUMMARY OF THE INVENTION

It is an object to be able to construct vents easily either in concrete or wood structures to provide a vent opening having a smooth, durable finish.

More particularly, it is an object to provide a vent frame that can be installed easily in a concrete form or in an aperture in a wood wall and which can be left in place to form the vent.

A further object is to provide such a vent frame which is quick and easy to assemble and install and which will be anchored securely in concrete when used in conjunction with concrete formwork.

It is also an object to provide a closure for such a vent opening which can be put in place and removed quickly, which will be held securely in place without requiring a separate fastening operation, and which will close the vent tightly.

It is preferred that such vent frame be formed of plastic material, which is economical while being strong and durable.

The vent frame is constructed so that it can be shipped easily and economically.

These objects can be accomplished by a plastic frame having flared peripheral walls enabling them to be nested for shipment, which frames can be assembled with a screen cloth covering the vent aperture and then installed in connection with concrete formwork or inserted into a frame opening and anchored in place.

BRIEF DESCRIPTION OF THE DRAWINGS

FIG. 5 is a top perspective of a vent frame in assembled condition ready for installation in a concrete form, and FIG. 6 is a similar view with parts in exploded relationship.

FIG. 7 is a transverse section through vent frame components in nested relationship.

DETAILED DESCRIPTION

Figure 1:
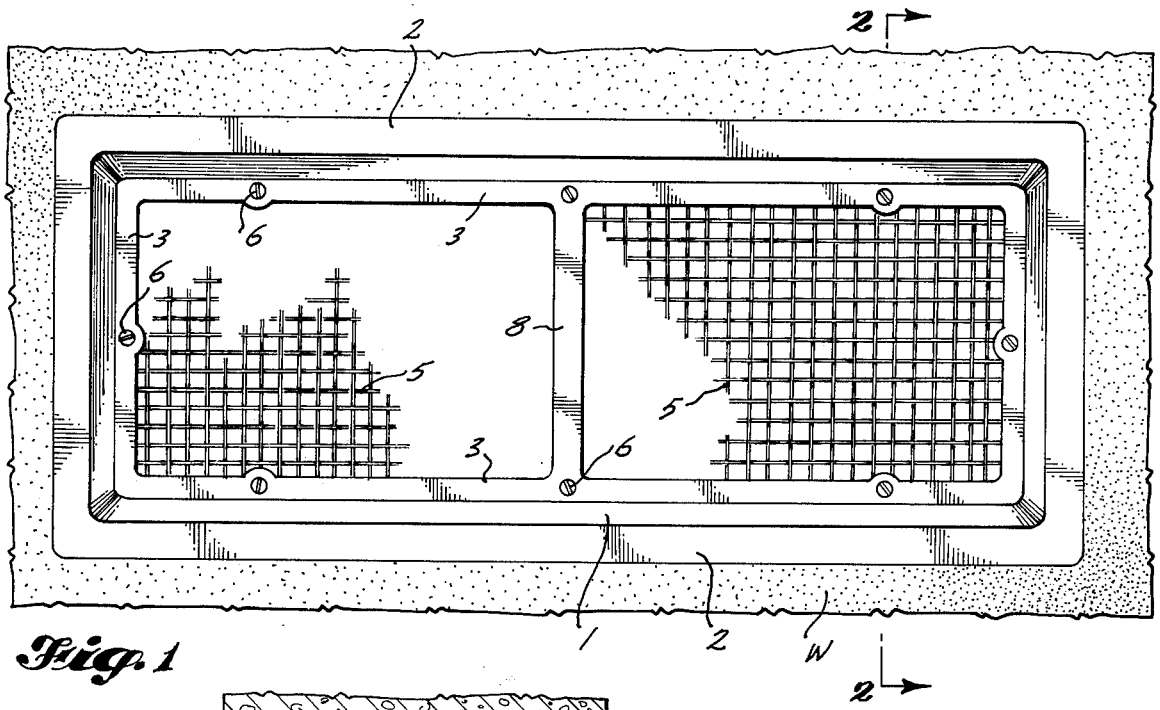
FIG. 1 is an elevation of a vent utilizing the vent frame of the present invention.

The same type of vent frame according to the present invention can be installed in any concrete wall, such as in a basement or foundation wall, or in a wall of frame construction. FIG. 1 shows the vent frame as being installed in a poured concrete wall. The frame thus installed is of the type shown best in FIGS. 2, 5 and 6. The frame includes a peripheral wall 1 encircling a rectangular opening and having an external flange 2 projecting outwardly from its outer end and an internal flange 3 projecting inwardly from its inner end.

Figure 2:
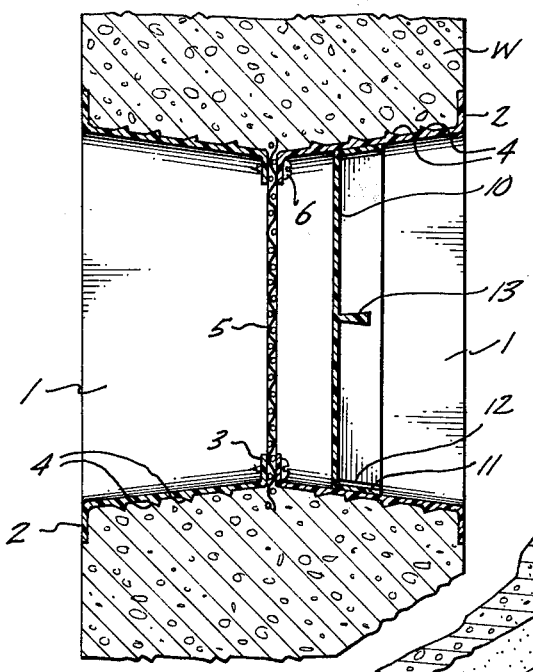
FIG. 2 is a transverse section through the vent taken on line 22 of FIG. 1.
Figure 4:
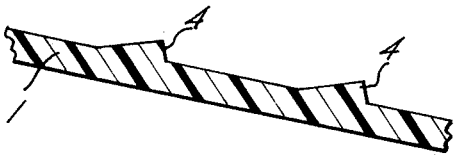
FIG. 4 is a fragmentary detail section of a portion of the vent frame wall.

The frame components are of a depth so that two frame components can be assembled in back-to-back relationship as shown in FIGS. 2, 5 and 6, to produce a composite structure of a depth corresponding to the thickness of the wall W in which the vent frame structure is to be installed. When thus installed the flanges 2 may be secured to the inner walls of a concrete form, so that when the form is removed after the concrete is poured, the outer faces of the flanges 2 will be flush with the surrounding faces of the concrete wall W as shown in FIG. 2

It will be apparent from FIG. 2 that the external flanges 2 anchor the vent frame in the concrete because the concrete is shown as having flowed in between the flanges. The vent frame can be anchored further to the concrete wall by the projections 4 shown in the form of ribs projecting outwardly from the exterior of the walls 1 in spaced relationship parallel to the flanges 2. Such ribs not only provide for additional anchoring of the vent frame in the concrete but also stiffen the vent frame. Such vent frame conveniently can be made of hard, stiff, plastic material, such as polyethylene.

The vent aperture inwardly of the internal flange 3 is closed by screen cloth or hardware cloth. The mesh of such cloth can be selected depending upon the particular type of installation in which the vent is to be provided. Preferably, the sheet of screen cloth is somewhat larger than the inner end of the vent frame over which it is to be fitted. Such relative size is shown best in FIG. 5. When concrete is poured into a form in which the vent frame has been installed, therefore, the concrete will flow not only into adjacent contact with the exterior of the vent frame walls, but also around the margin of the cloth sheet and through the interstices of such marginal portions to anchor the cloth sheet securely in the concrete and seal the edges of such sheet relative to the concrete. Before the frame is installed in a concrete form, its components will be assembled in a manner indicated in FIGS. 5 and 6. The screen cloth sheet 5 will be placed between the internal flanges 3 of two frame components disposed in back-to-back relationship. With the inner ends of such frames in registration, fasteners such as sheet metal screws 6 can be screwed through registering holes 7 in the internal flanges of the two components at the opposite sides of the screen sheet and through apertures in the screen sheet. Such sheet metal screws will then hold the components together in the form of the unit shown in FIG. 5, ready for installation in a concrete form.

Figure 3:
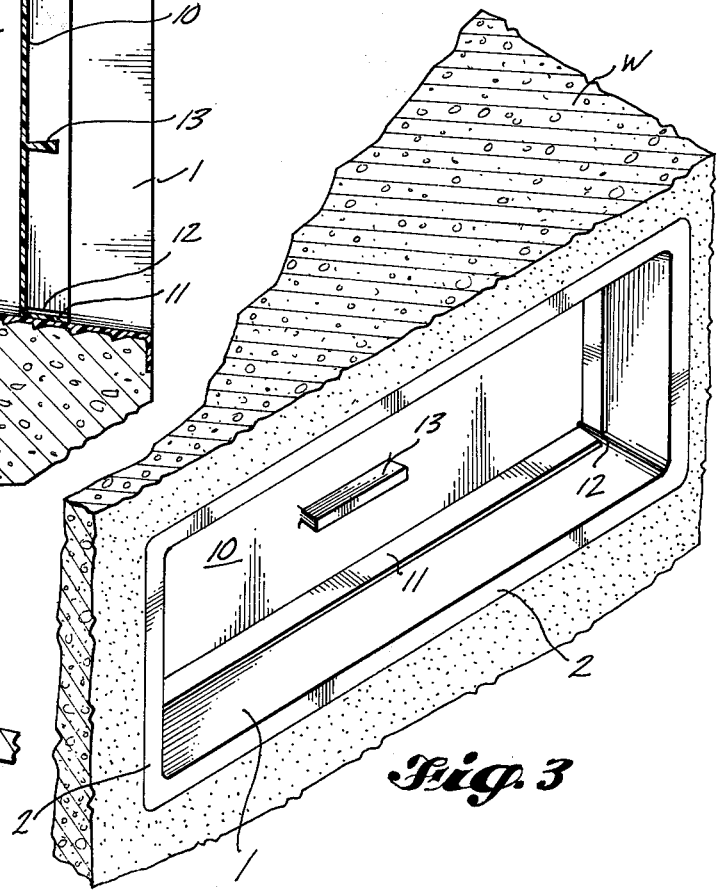
FIG. 3 is a top perspective of the vent in closed condition.

The assembled vent frame can be secured in a concrete form by driving nails through the external flanges 2 or by suppoerting the frame on form ties of the form. In either case, after the concrete wall W has been poured and the form walls have been removed, the vent frame will be permanently anchored in the wall in the manner indicated in FIG. 2, with the projecting ribs 4 embedded in the concrete. The external flanges 2 will be flush with the corresponding outer surfaces of the wall W, as shown in FIGS. 2 and 3. The shape of the vent formed by the frame can differ, but prefereably it is of elongated, rectangular shape. Under such circumstances it may be desirable to provide a crosstie 8 disposed coplanar with the internal flanges 3.

In order to facilitate storage and shipping of the vent frame components, it is preferred that the peripheral wall 1 be flared so that the frame components can nest compactly as shown in FIG. 7. Within such nesting flared peripheral wall components, a bag 9 can be provided to hold sheet metal screws 6 and sheets of screen cloth can be laid across the outer flanges so that all of the components of the vent frame can be packed together.

During cold weather the vents can be closed by suitable closures. Such a closure can take the form of a sheet cover 10 shown in FIGS. 2 and 3. Such cover has resilient marginal flanges 11 tending to fold toward the plane of the sheet 10. These flanges have corner notches 12 enabling such flanges to swing away from such plane. The cover can be handled and manipulated by a handlebar 13 projecting outwardly from the central portion of the cover.

Figure 8:
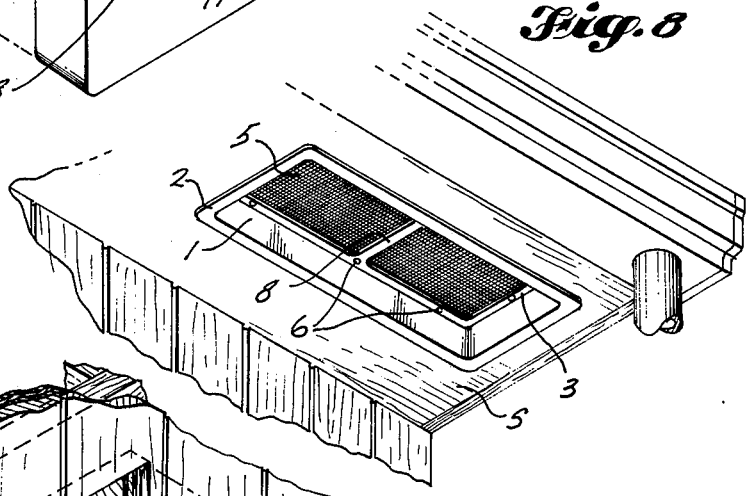
FIG. 8 is a bottom perspective showing a vent frame installed in a soffit.

The portion of the cover inwardly of the flanges 11 should be of a shape corresponding to the shape of the area within the peripheral wall 1 and of a size equal to the size of such aperture at a location between the external flanges 2 and the internal flanges 3. If the cover is pushed inwardly through the outer end of the peripheral wall 1 with the flanges 11 projecting outwardly, the outer edges of the flanges will engage the peripheral wall 1 first. As the cover 10 is pressed farther inward while being maintained parallel to the plane of the outer end of the peripheral wall 1, contact of the flanges with the peripheral wall 1 will fold such flanges progressively away from the plane of the cover sheet until the roots of such flanges engage the peripheral wall 1 as shown in FIGS. 2 and 3. Further movement of the cover inwardly relative to the peripheral wall 1 will thus be arrested and the resiliency of the flanges 11 will provide a tight seal between the cover and the peripheral wall and will deter inadvertent movement of the cover outward toward the outer end of the peripheral wall. Instead of mounting the vent frame in a concrete wall as described, one component of such frame can be mounted in a soffit S in the manner shown in FIG 8. In this instance the vent frame can be formed by only one of the flared wall components and sheet of screen cloth. The sheet metal or wood screws 6 can be screwed into a backing (not shown) provided around the margin of the vent aperture, both to secure the screen cloth in place relative to the plastic frame and to secure the internal flange 3 to the soffit structure so as to hold the vent frame in place in the soffit.

Figure 9:
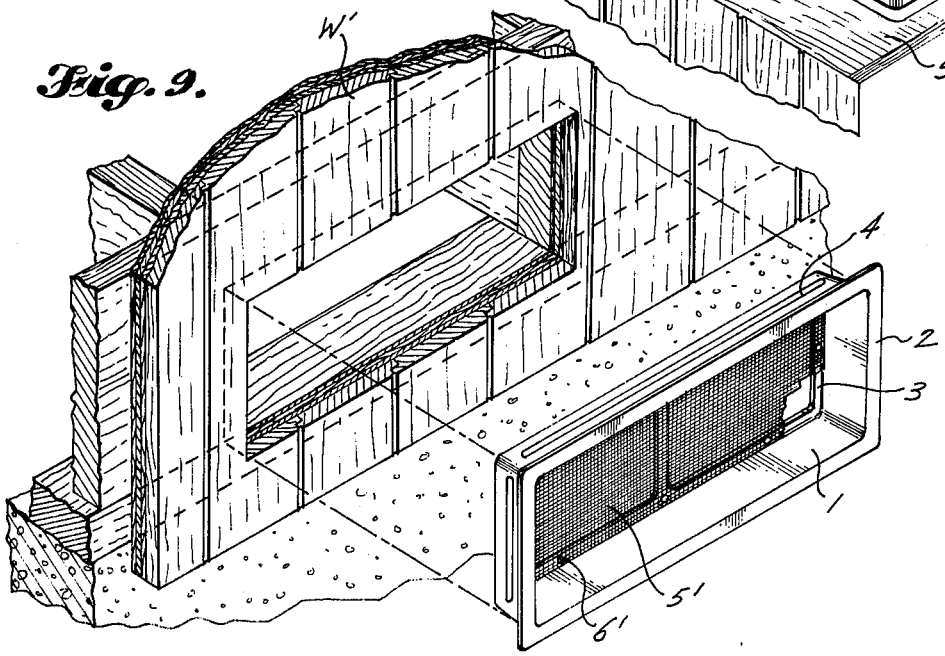
FIG. 9 is a top perspective of a frame wall having an aperture for receiving a vent frame and of the vent frame to be installed shown in exploded relationship.

FIG. 9 shows another representative installation of one flared wall component in an aperture in a frame wall W'. In this instance the screen cloth 5' is simply secured internally of the wall component to the internal flanges 3 by sheet metal screws or bolts as may be preferred. The vent frame component can then be secured in the wall aperture by bonding the external flange 2 to the margin of the aperture or by attaching such flange by nails or screws extending through it.

Figure 10:
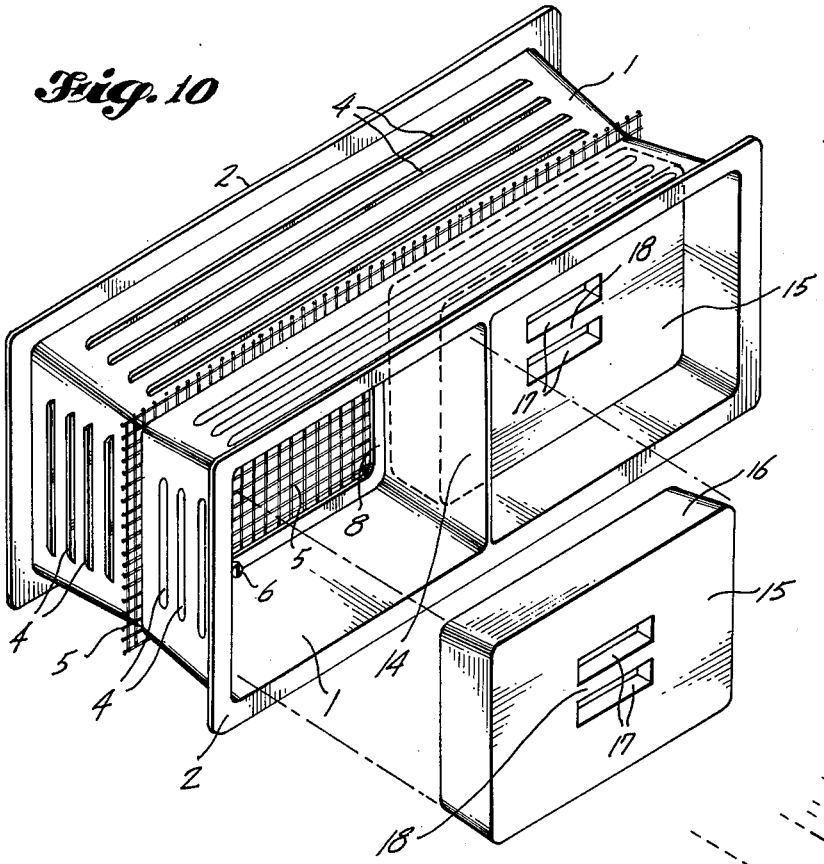
FIG. 10 is a top perspective of a modified type of vent frame.

FIG. 10 showns a somewhat modified type of vent frame in which the peripheral wall 1, external flange 2 and internal flange 3 are the same as in the type of frame described above. The structure of this frame is more suitable for larger vent openings, however, because it includes a central divider wall 14 in alignment with the crosstie 8. The assembly of two flared wall components in back-to-back relationship at opposite sides of a screen cloth sheet 5 is the same as described above. This type of vent frame can be installed in the same manner as described in a concrete wall. In this instance the closure is shown as being in the form of a thick plug 15 of foam plastic material such as polystyrene. The edges 16 of such plug are inclined corresponding to the flare of the vent frame walls formed by the wall 1 and the divider 14. A handled for manipulating the plug can be formed by spaced, parallel recesses 17 which provide a handle strip 18 between them. Such plug can be inserted into a recess of the vent frame in the manner indicated in FIG. 10.

I claim:

1. A sectional vent frame comprising a pair of identical hollow frame sections flared over substantially their entire widths, and joining means joining said frame sections in back-to-back adjacent relationship for cooperatively forming a passage therethrough and with each frame section flaring away from the other frame section.

2. The sectional vent frame defined in claim 1, and a piece of screen cloth extending across the passage and clamped between the joined frame sections by the joining means.

3. The sectional vent frame defined in claim 2, in which the piece of screen cloth is larger than the adjacent portions of the frame sections so that the marginal portion of the screen cloth projects outwardly beyond the adjacent portions of the frame sections for embedment in concrete surrounding such frame sections.

4. The sectional vent frame defined in claim 1, in which the adjacent portions of the frame sections are of rectangular profile, each side of the rectangle having an internal flange, all of said flanges in each sections being coplanar, and crosstie means spanning across the portion of each frame section adjacent to the other frame section, disposed generally parallel to the shorter sides of such rectangular frame section adjacent portions and connecting opposite flanges.

5. The sectional vent frame defined in claim 4, in which the portion of a first flared frame section adjacent to the other flared frame section defines a plane and said first flared frame section includes a divider wall disposed substantially perpendicular to such plane.

6. The sectional vent frame defined in claim 1. and a plug closure for the passage through the frame sections receivable within one of the flared frame sections and having an edge portion tapered complement to the flared interior of such one frame section and of a width for effecting a seal between the plug closure and the interior of such flared frame section over a substantial distance transversely of the junction between the frame sections.

7. The sectional vent frame defined in claim 6. in which the plug closure includes a sheet cover having resilient sheet flanges projecting from the edge portions of said cover away from the junction between the flared frame sections.

8. The sectional vent frame defined in claim 6 in which the entire plug closure is of insulating rigid foam plastic material and includes edge portions tapered complement to the flare of the frame section in which the plug closure is lodged and of a substantial extent in a direction transversely of the junction between the frame sections.

* * * * *

UNITED STATES PATENT OFFICE

CERTIFICATE OF CORRECTION

Patent No. 4,026,082 Dated May 31, 1977

Inventor(s) Percy Crofoot

It is certified that error appears in the above-identified patent and that said Letters Patent are hereby corrected as shown below:

Title page, section (56) References Cited, insert --620,515 2/1899 Tripp.....160/104--.

Column 4, line 58, cancel the period after "claim 1" and insert a comma; line 61, cancel "complement" and insert --complemental--; line 67, cancel the period after "claim 6" and insert a comma.

Column 5, line 4, insert a comma after "claim 6".

Column 6, line 1, cancel "complement" and insert --complemental--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*